US005237829A

United States Patent [19]

Kobayashi et al.

[11] Patent Number: 5,237,829

[45] Date of Patent: Aug. 24, 1993

[54] ICE-MAKING MACHINE HAVING THERMAL RELAY

[75] Inventors: Toshio Kobayashi, Tochigi; Eiji Kuroda, Gunma, both of Japan

[73] Assignee: Japan Servo Co., Ltd., Tokyo, Japan

[21] Appl. No.: 921,525

[22] Filed: Jul. 29, 1992

[51] Int. Cl.[5] ..... F25C 1/00

[52] U.S. Cl. ..... 62/135; 200/293; 361/809

[58] Field of Search ..... 62/135; 248/904; 200/293, 294, 296; 361/417, 419

[56] References Cited

U.S. PATENT DOCUMENTS

| | | | |
|---|---|---|---|
| 3,033,328 | 10/1961 | Bauerlein | 62/135 |
| 4,741,169 | 5/1988 | Linstromberg | 62/135 |
| 4,796,158 | 1/1989 | Sim | 361/417 |
| 4,833,894 | 5/1989 | Chesnut | 62/135 |
| 4,864,471 | 9/1989 | Hargasser et al. | 361/419 X |
| 5,010,738 | 4/1991 | Brown et al. | 62/135 |

*Primary Examiner*—William E. Tapolcai
*Attorney, Agent, or Firm*—Nilles & Nilles

[57] ABSTRACT

An ice-making machine has a thermal relay in which resilient mounting arms are formed at both sides of the thermal relay. A concave portion for receiving the thermal relay and grooves for receiving tip ends of the resilient mounting arms are formed on a surface of a case. The surface is brought into intimate contact with an ice-making tray. The thermal relay is urged toward the ice-making tray through the resilient mounting arms by bottom walls of the grooves.

6 Claims, 5 Drawing Sheets

ICE-MAKING MACHINE HAVING THERMAL RELAY

BACKGROUND OF THE INVENTION

1. Field of the Invention

This invention relates to an ice-making machine having a thermal relay, and more particularly to an automatic ice-making machine, for use in a refrigerator, which has a thermal relay for detecting the temperature of an ice-making tray in order to repeat the ice-making operation.

2. Description of the Prior Art

FIG. 1 shows an ice-making machine. In FIG. 1, reference numeral 1 designates an ice-making tray, 2 is a control box arranged at one side of the ice-making tray 1, 3 is a thermal relay disposed in the control box 2 so as to be brought into intimate contact with the ice-making tray 1, 4 is a rotary shaft for separating ice pieces made in the ice-making tray 1, and 5 is a water supply port for supplying water into the ice-making tray 1.

In such a conventional ice-making machine, water is supplied to the ice-making tray 1 through the water supply port 5 and transformed into ice by cooled air in the refrigerator. When the temperature of the ice is lowered to a predetermined value, the lowered temperature is detected by the thermal relay 3 so that a motor (not shown) is turned on and the rotary shaft 4 thereof is rotated. As a result, the ice pieces are pushed away from the ice-making tray 1 by the rotary shaft.

In such an operation, it is very important that the thermal relay 3 can detect temperature with a high precision and, accordingly, it is necessary to pay close attention when the thermal relay 3 is mounted to the ice-making tray 1.

FIGS. 2 to 7 illustrate a conventional mounting arrangement of the thermal relay. In the method shown in FIGS. 2 and 3, the thermal relay 3 is inserted into a case **6*b* having mounting arms 6*a* and molded with plastic materials. Each of the arms 6*a* is fixed to the control box 2 by means of a screw 7 to bring a temperature sensing portion of the thermal relay 3 into contact with the ice-making tray 1. In this case, the effective length of the arm 6*a* becomes small because a portion of the arm 6*a* is fixed to the control box 2 by the screw. Thus, the spring constant of the arm 6*a*** becomes relatively large.

In the arrangement shown in FIGS. 4 and 5, the thermal relay 3 is fixed to the control box 2 by a screw 7 through a spring plate **6*c***. In this case, the mounting of the thermal relay is unstable, so that a spring plate having a relatively large spring constant must be used.

In the arrangement shown in FIGS. 6 and 7, the thermal relay 3 is inserted into a concave portion 8 formed on an outer wall of the control box 2. A spring plate **6*d* in the form of wedge is inserted between the concave portion 8 and the outer wall to fix the thermal relay 3 to the concave portion 8. In this case, the spring plate 6*d* cannot be long, because it must be inserted into a relatively narrow space. Further, because the spring plate 6*d* is formed separately from the thermal relay 3**, a great deal of skill is required to assemble them.

As stated above, the conventional ice-making machine has so many drawbacks that the space required for mounting the thermal relay is limited. Accordingly, when the thermal relay is mounted, much time and skilled labor are required in order to maintain constant a contact pressure of the thermal relay against the ice-making tray. This is because a dimensional error of the thermal relay mounting portion affects to a large extent the contact pressure of the thermal relay, particularly if the spring constant is set large in order to obtain high mounting forces.

Further, if the contact pressure of the thermal delay is too large, the temperature sensing portion of the thermal relay is deformed and the setting temperature is varied. On the other hand, a temperature detection error becomes large if the contact pressure is too small.

SUMMARY OF THE INVENTION

An object of the present invention is to solve the problems thus far described and to provide an ice-making machine comprising a thermal relay having resilient mounting arms at both sides thereof, an ice-making tray, a box for the thermal relay, and a concave portion formed on a surface of the box for receiving the thermal relay. The concave surface is brought into contact intimately with said ice-making tray, and grooves are formed on the surface of the box for receiving tip ends of the resilient mounting arms, respectively. The thermal relay is urged toward the ice-making tray by bottom surfaces of the grooves through the resilient mounting arms.

The above and other objects as well as advantageous features of the present invention will become apparent from the following description of the preferred embodiments considered in conjunction with the accompanying drawings.

DETAILED DESCRIPTION OF THE PREFERRED EMBODIMENTS

Figure 1:
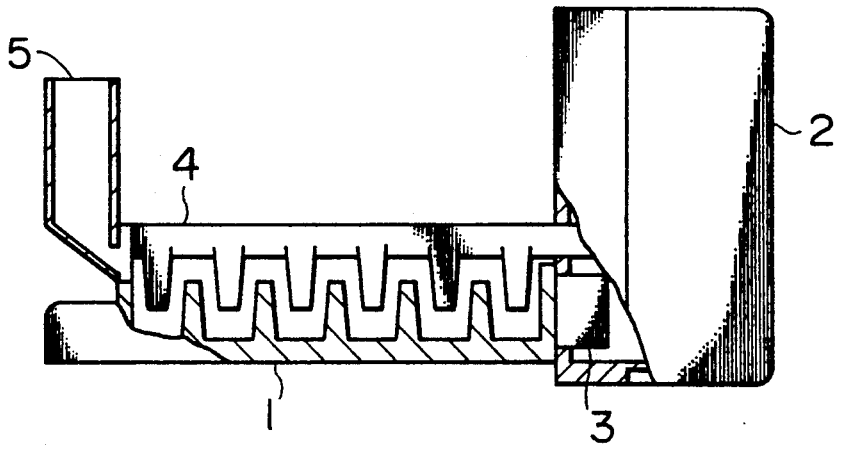
F I G . 1 PRIOR ART
FIG. 1 is a sectional side view of a conventional ice-making machine having a thermal relay.
Figure 2:
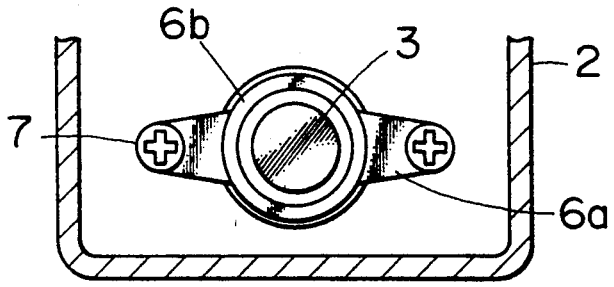
F I G . 2 PRIOR ART
FIG. 2 is a plan view of a thermal relay mounting portion of the conventional ice-making machine of FIG. 1.
Figure 3:
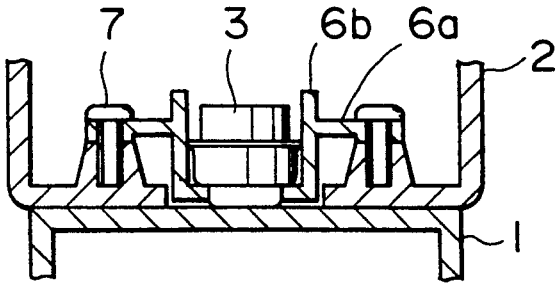
F I G . 3 PRIOR ART
FIG. 3 is a sectional front view of the thermal relay mounting portion of the conventional ice-making machine shown in FIG. 2; .
Figure 4:
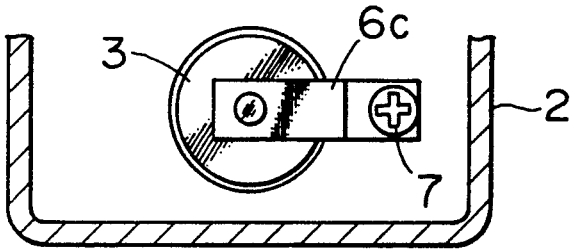
F I G . 4 PRIOR ART
FIG. 4 is a plan view of a thermal relay mounting portion of another conventional ice-making machine.
Figure 5:
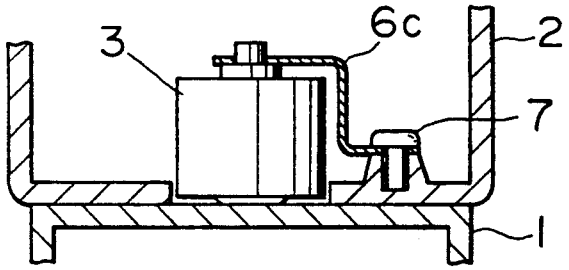
F I G . 5 PRIOR ART
FIG. 5 is a sectional front view of the thermal relay mounting portion of the conventional ice-making machine shown in FIG. 4.
Figure 6:
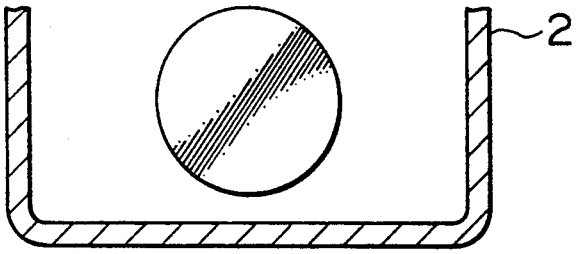
F I G . 6 PRIOR ART
FIG. 6 is a plan view of a thermal relay mounting portion of another conventional ice-making machine.
Figure 7:
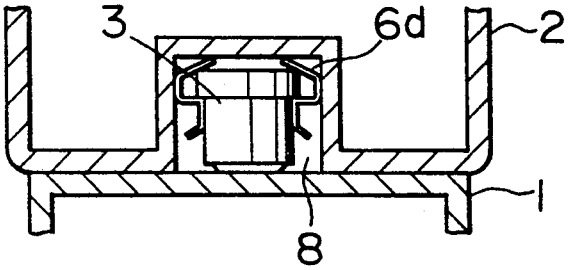
F I G . 7 PRIOR ART
FIG. 7 is a sectional front view of the thermal relay mounting portion of the conventional ice-making machine shown in FIG. 6.
Figure 8:
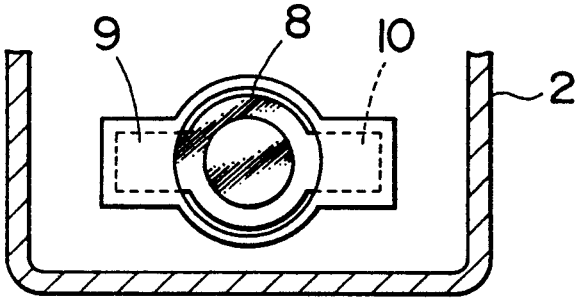
FIG. 8 is a plan view of a thermal relay mounting portion of an ice-making machine according to the present invention.
Figure 9:
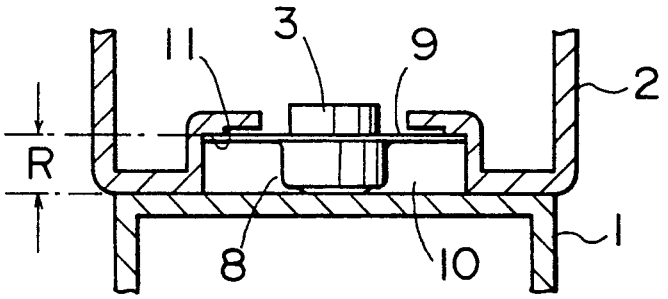
FIG. 9 is a sectional front view of the thermal relay mounting portion shown in FIG. 8.
Figure 10:
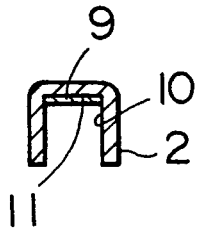
FIG. 10 is a sectional side view of the thermal relay mounting portion shown in FIG. 9.
Figure 11:
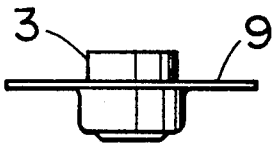
FIG. 11 is a front view of the thermal relay shown in FIG. 9.
Figure 12:
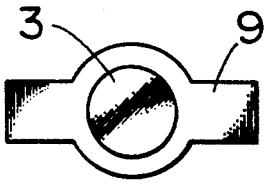
FIG. 12 is a plan view of the thermal relay shown in FIG. 11.

An embodiment of an ice-making machine having a thermal relay according to the present invention is shown in FIGS. 8 to 12. In this embodiment of the present invention, resilient planar mounting arms 9 extending in a horizontal direction are provided at both sides of a thermal relay 3. Channel shaped grooves 10 for receiving therein the arms 9 are formed at both sides of a concave center portion 8 formed on an outer wall of a control box 2, the wall being brought into intimate contact with an ice-making tray 1.

The thermal relay 3 is fixed to the control box 2 when the thermal relay 3 is inserted into the concave center portion 8 because the arms 9 are fitted into grooves 10 at the same time. In this state, a temperature sensing portion of the thermal relay 3 is pressed under a predetermined pressure to the ice-making tray 1 because arms 9 are urged toward the ice-making tray 1 by bottom wall portions 11 of the grooves 10.

In the embodiment of the present invention shown in FIGS. 8 to 12, the length of arm 9 can be set large enough and the spring constant of the arm 9 can be made sufficiently small so that the fluctuation of the spring force of each arm 9 due to the dimensional error thereof can be suppressed. Further, the contact pressure of the thermal relay 3 to the ice-making tray 1 can be set precisely by determining a depth R of the groove 10 exactly. Arms 9 and the thermal relay 3 can be formed as a unit or separately.

Figure 13:
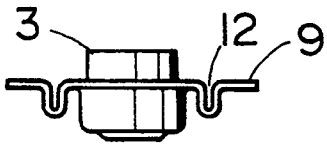
FIG. 13 is a front view of a thermal relay according to another embodiment of the present invention.
Figure 14:
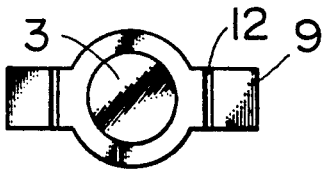
FIG. 14 is a plan view of the thermal relay shown in FIG. 13.

In an another embodiment of the present invention, shown in FIGS. 13 and 14, a bent portion 12 is formed on each arm 9, so that the spring constant thereof can be set small.

Figure 15:
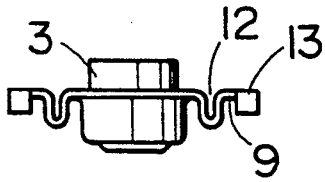
FIG. 15 is a front view of a thermal relay according to a further embodiment of the present invention.
Figure 16:
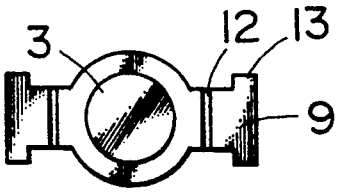
FIG. 16 is a plan view of the thermal relay shown in FIG. 15.
Figure 17:
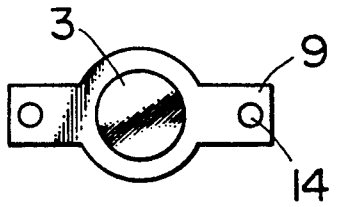
FIG. 17 is a plan view of the thermal relay of still another embodiment of the present invention.
Figure 18:
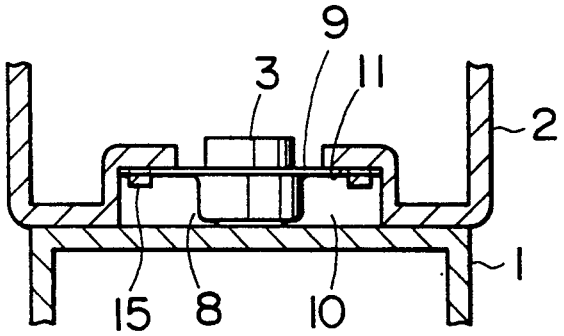
FIG. 18 is a sectional front view of the thermal relay mounting portion having the thermal relay shown in FIG. 17.

In a further embodiment of the present invention, shown in FIGS. 15 and 16, flag portions 13 are provided at both sides of the tip end of each arm 9, so that each of the flag portions 13 is deformed and forcibly inserted into the groove 10 when the respective arm 9 is inserted into the groove 10. In the other embodiment of the present invention, shown in FIGS. 17 and 18, a hole 14 is formed on the tip end of each of the arms 9. Projections 15 are formed on the bottom wall 11 of each of the grooves 10 in order to connect the thermal relay 3 with the control box 2 when the projections 15 are fitted into the holes 14.

EFFECT OF THE INVENTION

According to the ice-making machine of the present invention, the thermal relay 3 can be mounted precisely on the desired position in the control box 2 in spite of the simple mounting construction. Further, the arms 9 of the thermal relay 3 can be utilized as a spring, so that the spring constant can be made small without reducing the strength of the arms 9 and so that the fluctuation of the contact pressure between the thermal relay and the ice-making tray due to mounting errors can be sufficiently suppressed.

What is claimed is:

1. An ice-making machine comprising: a thermal relay having resilient mounting arms at both sides thereof; an ice-making tray; a box for said thermal relay; a concave portion being formed on a surface of said box for receiving said thermal relay, said surface being brought into contact intimately with said ice-making tray; wherein grooves are formed on said surface of said box for receiving tip ends of said resilient mounting arms, respectively, and wherein said thermal relay is urged toward said ice-making tray by bottom surfaces of said grooves through said resilient mounting arms.

2. The ice-making machine as claimed in claim 1, wherein each of said resilient mounting arms has a bending portion.

3. The ice-making machine as claimed in claim 1, wherein each of said resilient mounting arms has flag portions at both sides of the tip end thereof, which are forcibly inserted into said groove.

4. The ice-making machine as claimed in claim 2 wherein each of said resilient mounting arms has flag portions at both sides of the tip end thereof, which are forcibly inserted into said groove.

5. The ice-making machine as claimed in claim 1, wherein each of said resilient mounting arms has a hole at the tip end thereof, and each of said grooves has a projection at a bottom wall surface thereof, said projections being fitted into said holes.

6. The ice-making machine as claimed in claim 2, wherein each of said resilient mounting arms has a hole at the tip end thereof, and each of said grooves has a projection at a bottom wall surface thereof, said projections being fitted into said holes.

* * * * *